US010456942B2

(12) United States Patent
Hsu

(10) Patent No.: US 10,456,942 B2
(45) Date of Patent: Oct. 29, 2019

(54) CUTTING METHOD

(71) Applicant: Yuan-Chi Hsu, New Taipei (TW)

(72) Inventor: Yuan-Chi Hsu, New Taipei (TW)

( * ) Notice: Subject to any disclaimer, the term of this patent is extended or adjusted under 35 U.S.C. 154(b) by 71 days.

(21) Appl. No.: 15/950,199

(22) Filed: Apr. 11, 2018

(65) Prior Publication Data

US 2018/0229389 A1 Aug. 16, 2018

Related U.S. Application Data

(63) Continuation of application No. 14/822,895, filed on Aug. 10, 2015, now Pat. No. 9,969,097.

(30) Foreign Application Priority Data

Sep. 29, 2014 (CN) ..... 2014 2 0569187 U

(51) Int. Cl.

| | |
|---|---|
| ***B26D 7/26*** | (2006.01) |
| ***B26D 7/01*** | (2006.01) |
| ***B26D 1/04*** | (2006.01) |
| ***B26D 5/08*** | (2006.01) |

(52) U.S. Cl.

CPC ..... *B26D 7/015* (2013.01); *B26D 1/045* (2013.01); *B26D 5/08* (2013.01)

(58) Field of Classification Search

CPC ..... B26D 1/045; B26D 5/08; B26D 7/015; B21D 45/006; Y10T 83/2159; Y10T 83/8696

See application file for complete search history.

(56) References Cited

U.S. PATENT DOCUMENTS

| | | | |
|---|---|---|---|
| 3,269,240 | A | 8/1966 | Killaly |
| 4,031,616 | A | 6/1977 | Hines |
| 5,094,134 | A | 3/1992 | Mizukoshi |
| 6,505,385 | B2 | 1/2003 | Grunberger |
| 6,684,514 | B2 | 2/2004 | Welch |
| 7,806,309 | B2 | 10/2010 | Korchmar |
| 7,930,958 | B2 | 4/2011 | Workman |

(Continued)

FOREIGN PATENT DOCUMENTS

| | | | |
|---|---|---|---|
| CN | 101284381 | A | 10/2008 |
| JP | H04-156846 | A | 5/1992 |

(Continued)

*Primary Examiner* — Stephen Choi
(74) *Attorney, Agent, or Firm* — Winston Hsu

(57) ABSTRACT

A cutting method includes a pipe of a cutting tool driving a pressing foot assembly of the cutting tool to press against an object in a direction; the pressing foot assembly sliding along the direction by cooperation of a sliding block of the pressing foot assembly and a sliding slot on the pipe to compress a spring of the cutting tool; the compressed spring generating a resilient force for driving the pressing foot assembly to collapse a plurality of wave-shaped core layers of the object; and after the plurality of wave-shaped core layers of the object is collapsed by the pressing foot assembly, a blade assembly of the cutting tool protruding from the pressing foot assembly via an opening on the pressing foot assembly and being driven to cut the collapsed object along another direction perpendicular to the direction without oscillation as the cutting tool moves along the another direction.

7 Claims, 8 Drawing Sheets

(56) References Cited

U.S. PATENT DOCUMENTS

| | | | | |
|---|---|---|---|---|
| 2004/0094003 | A1* | 5/2004 | Bar-Erez | B23P 15/00<br>83/13 |
| 2005/0186010 | A1* | 8/2005 | Shibata | B26D 7/015<br>400/621 |
| 2009/0266209 | A1 | 10/2009 | Thielges | |
| 2011/0280999 | A1 | 11/2011 | Crystal | |
| 2014/0165808 | A1 | 6/2014 | Fujihara | |
| 2015/0273718 | A1 | 10/2015 | Yu | |

FOREIGN PATENT DOCUMENTS

| | | | |
|---|---|---|---|
| JP | H06-39388 | U | 5/1994 |
| JP | H08-71980 | A | 3/1996 |
| JP | 2013-193193 | A | 9/2013 |
| TW | 583076 | | 4/2004 |

* cited by examiner

CUTTING METHOD

CROSS REFERENCE TO RELATED APPLICATIONS

This is a continuation application of U.S. patent application Ser. No. 14/822,895, filed on Aug. 10, 2015, the contents of which are incorporated herein by reference.

BACKGROUND OF THE INVENTION

1. Field of the Invention

The present invention relates to a cutting method, and more particularly, to a cutting method of a corrugated sheet.

2. Description of the Prior Art

A conventional cutting tool includes a body coupled to a motor, a socket, and a blade. The blade is fixed on an end of the body. The conventional cutting tool is assembled on a computer-aided manufacturing (CAM) machine and is driven to swing up and down vertically and move horizontally by the motor for cutting a sheet, such as a corrugated sheet or a solid sheet. Swinging amplitude of the conventional cutting tool driven by the motor is designed according to number of manufactured short fibers of the sheet. When it is desired to cut a corrugated sheet with numerous manufactured short fibers, it sets the larger swinging amplitude of the conventional cutting tool, so as to achieve a better cutting effect. However, it reduces a cutting speed of the conventional cutting tool. On the other hand, when it sets the smaller swinging amplitude to increase the cutting speed, the cutting effect gets worse. That is, the corrugated sheet may be torn due to cutting incompletion caused by the insufficient swinging amplitude or the excessive cutting speed of the conventional cutting tool. For example, when it is desired to cut a corrugated sheet with much more manufactured short fibers, it has to set the much larger swinging amplitude of the conventional cutting tool for abetter cutting effect. Otherwise, the blade cannot cut the corrugated sheet effectively, and the corrugated sheet may get torn. Therefore, when it is desired to cut a corrugated sheet with numerous manufactured short fibers, it needs to increase the swinging amplitude of the conventional cutting tool to ensure an enhanced cutting effect. However, it reduces the cutting speed.

Therefore, it becomes an important topic in the field to increase a cutting speed of the corrugated sheet and to enhance cutting precision of the corrugated sheet.

SUMMARY OF THE INVENTION

In order to solve the drawbacks as mentioned above, the present invention provides a cutting method of a corrugated sheet without swinging or oscillation.

In order to achieve the aforementioned objective, the present invention discloses a cutting method including a pipe of a cutting tool driving a pressing foot of a pressing foot assembly of the cutting tool to press against an object in a direction; the pressing foot of the pressing foot assembly driving an adapter ring of the pressing foot assembly to slide along the direction by cooperation of a sliding block of the pressing foot assembly and a sliding slot on the pipe; the adapter ring of the pressing foot assembly compressing a spring of the cutting tool; the compressed spring generating a resilient force for driving the pressing foot assembly to collapse a plurality of wave-shaped core layers of the object; and after the plurality of wave-shaped core layers of the object is collapsed by the pressing foot of the pressing foot assembly, a blade assembly of the cutting tool protruding from the pressing foot assembly via an opening formed on the pressing foot and being driven to cut the collapsed object along another direction perpendicular to the direction without oscillation as the cutting tool moves along the another direction.

According to an embodiment of the present invention, after the plurality of wave-shaped core layers of the object is collapsed by the pressing foot of the pressing foot assembly, the blade assembly of the cutting tool protruding from the pressing foot assembly via the opening formed on the pressing foot and being driven to cut the collapsed object along the another direction perpendicular to the direction without oscillation as the cutting tool moves along the another direction includes after the plurality of wave-shaped core layers of the object is collapsed by an arc protrusion formed on the pressing foot of the pressing foot assembly, the blade assembly of the cutting tool protruding from the pressing foot assembly via the opening formed on the arc protrusion on the pressing foot and being driven to cut the collapsed object along the another direction perpendicular to the direction without oscillation as the cutting tool moves along the another direction.

According to an embodiment of the present invention, the cutting method further includes adjusting a length of the blade protruding from the pressing foot assembly via the opening by an adjusting rod passing through the pipe and combined with a blade holder where the blade is fixed.

In order to achieve the aforementioned objective, the present invention further discloses a cutting method including identifying a plurality of wave-shaped core layers of an object; attaching a pressing foot with an arc protrusion of a pressing foot assembly of a cutting tool onto an adapter ring of the pressing foot assembly of the cutting tool according to identification of the plurality of wave-shaped core layers of the object; a pipe of the cutting tool driving the pressing foot with the arc protrusion to press against the object in a direction; the pressing foot of the pressing foot assembly driving the adapter ring of the pressing foot assembly to slide along the direction by cooperation of a sliding block of the pressing foot assembly and a sliding slot on the pipe; the adapter ring of the pressing foot assembly compressing a spring of the cutting tool; the compressed spring generating a resilient force for driving the pressing foot with the arc protrusion to collapse the plurality of wave-shaped core layers of the object; and after the plurality of wave-shaped core layers of the object is collapsed by the pressing foot with the arc protrusion of the pressing foot assembly, a blade assembly of the cutting tool protruding from the pressing foot assembly via an opening formed on the arc protrusion and being driven to cut the collapsed object along another direction perpendicular to the direction without oscillation as the cutting tool moves along the another direction.

According to an embodiment of the present invention, attaching the pressing foot with the arc protrusion of the pressing foot assembly of the cutting tool onto the adapter ring of the pressing foot assembly of the cutting tool according to the identification of the plurality of wave-shaped core layers of the object includes attaching the pressing foot with the arc protrusion of the pressing foot assembly of the cutting tool onto the adapter ring of the pressing foot assembly of the cutting tool by a first magnetic member disposed on the adapter ring and a second magnetic member disposed on the pressing foot and attracting with the first magnetic member according to the identification of the plurality of wave-shaped core layers of the object.

According to an embodiment of the present invention, attaching the pressing foot with the arc protrusion of the pressing foot assembly of the cutting tool onto the adapter ring of the pressing foot assembly of the cutting tool according to the identification of the plurality of wave-shaped core layers of the object includes engaging a register pin disposed on one of the adapter ring and the pressing foot with a register hole formed on the other one of the adapter ring and the pressing foot, such that a direction of the opening is parallel to a direction of the blade.

According to an embodiment of the present invention, the cutting method further includes adjusting a length of the blade protruding from the pressing foot assembly via the opening by an adjusting rod passing through the pipe and combined with a blade holder where the blade is fixed.

In summary, the pressing foot assembly of the cutting tool of the present invention keeps pressing against an object by the resilient force generated from the spring during a cutting process. When cutting a corrugated sheet, the wave-shaped core layers of the corrugated sheet are collapsed by the pressing foot assembly. The collapsed corrugated sheet is similar to a plurality of overlaid solid sheets, which allows the cutting tool to cut the collapsed corrugated sheet with a maximum cutting speed. In other words, since it is not required to drive the cutting tool to swing up and down by a motor anymore, a computer-aided manufacturing (CAM) machine can maximize a cutting speed to 100 percent of a design cutting speed when cutting the corrugated sheet without considering relations between the swinging amplitude of the cutting tool, properties of the corrugated sheet, and a horizontal moving speed of the cutting tool relative to the corrugated sheet. Furthermore, when cutting a solid sheet, it prevents the solid sheet from being pulled up by the blade, such that a through hole is prevented from being formed on the solid sheet, which allows the solid sheet to be fixed on a working platform stably and ensures a precise cutting effect. Besides, the present invention further utilizes the first magnetic members and the second magnetic members attracting with each other for detaching the pressing foot from the adapter ring or combining the pressing foot with the adapter ring conveniently. Therefore, when it is desired to cut another corrugated sheet with a different height or a solid sheet, it can replace the original pressing foot with another pressing foot conveniently.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
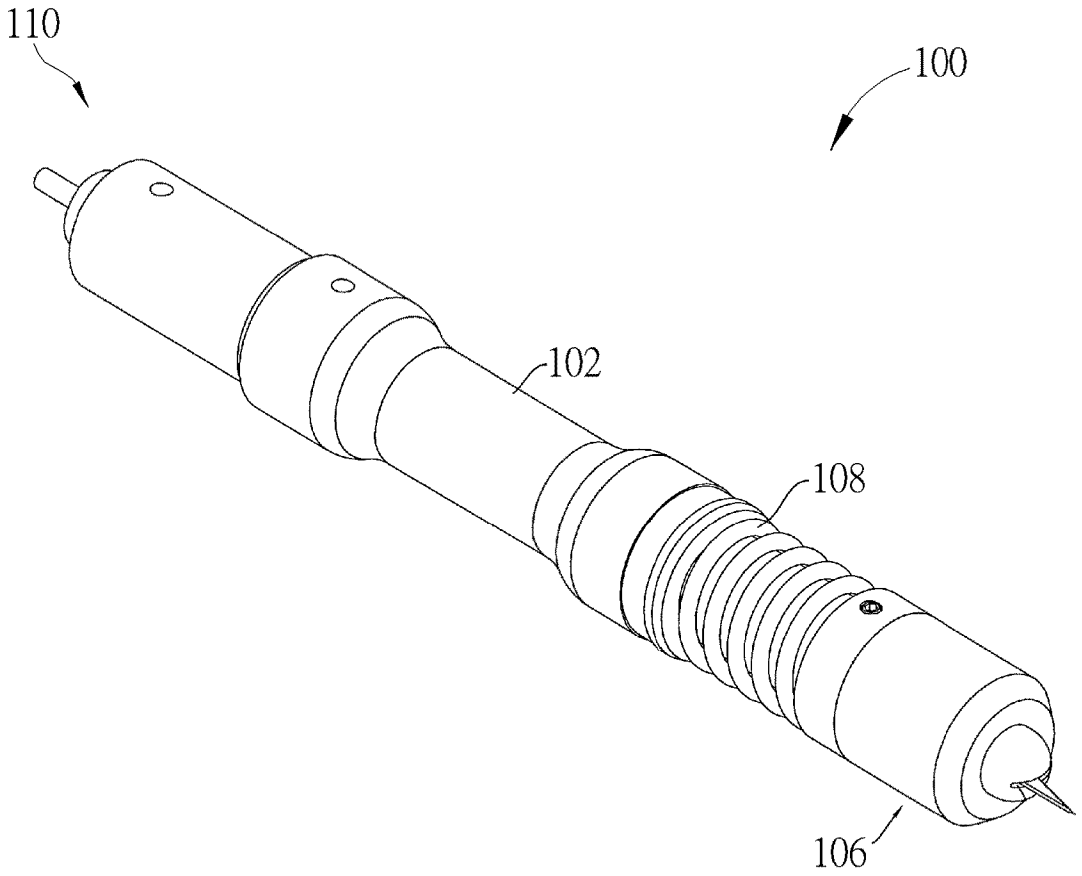
FIG. 1 is a schematic diagram of a cutting tool according to an embodiment of the present invention.
Figure 2:
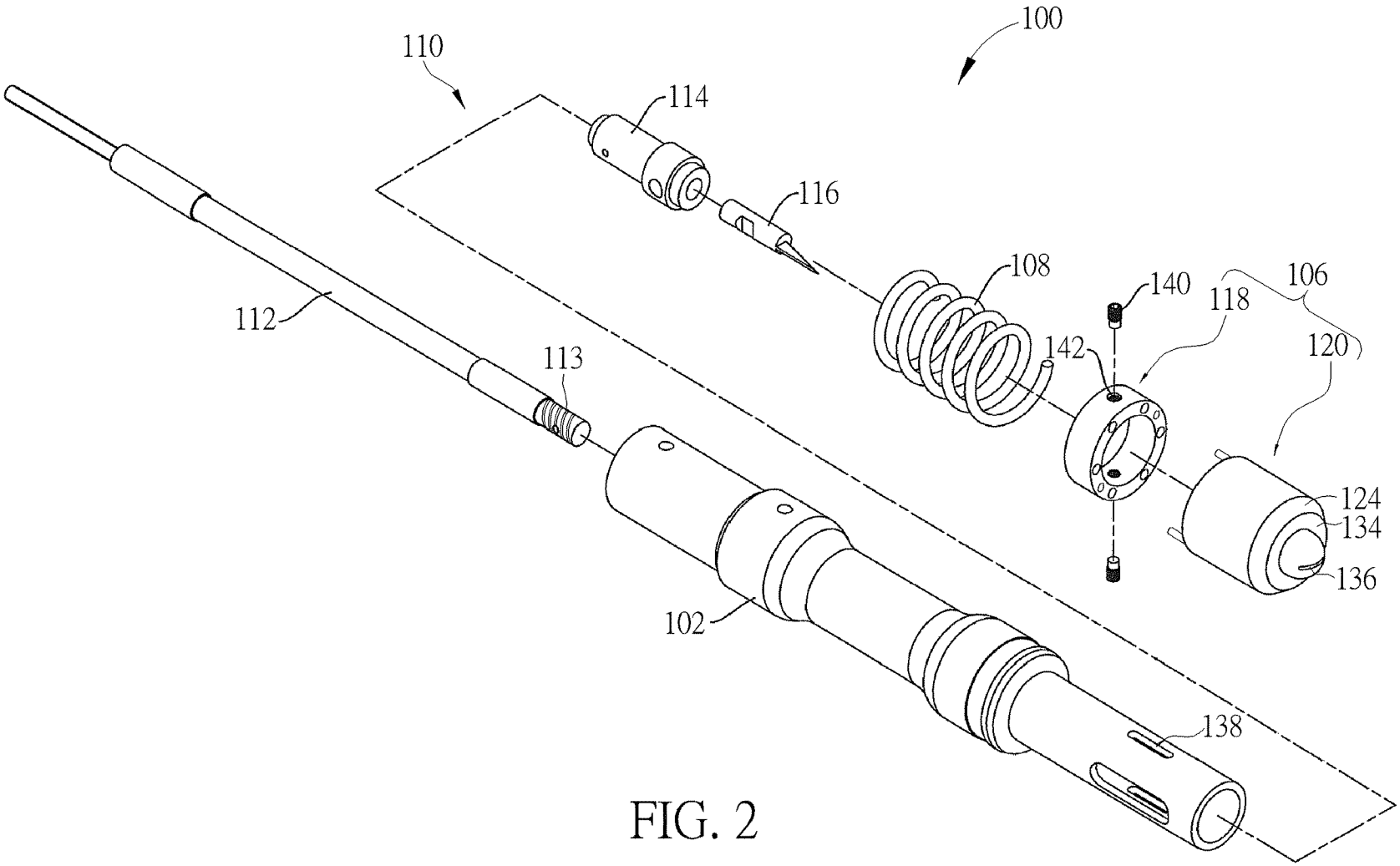
FIG. 2 is an exploded diagram of the cutting tool according to the embodiment of the present invention.

Please refer to FIG. 1 and FIG. 2. FIG. 1 is a schematic diagram of a cutting tool 100 according to an embodiment of the present invention. FIG. 2 is an exploded diagram of the cutting tool 100 according to the embodiment of the present invention. As shown in FIG. 1 and FIG. 2, the cutting tool 100 includes a pipe 102, a pressing foot assembly 106, a spring 108, and a blade assembly 110. The pressing foot assembly 106 is slidably sheathed on an end of the pipe 102. The spring 108 is sheathed on the pipe 102. An end of the spring 108 abuts against the pipe 102, and the other end of the spring 108 abuts against the pressing foot assembly 106. In this embodiment, the spring 108 can be a spring. The blade assembly 110 passes through the pipe 102 and the pressing foot assembly 106 in a slidable manner. The blade assembly 110 includes an adjusting rod 112, a blade holder 114, and a blade 116. The adjusting rod 112 passes through the pipe 102. An end of the blade holder 114 is fixed on an end of the adjusting rod 112. The blade 116 is fixed on the other end of the blade holder 114. In this embodiment, a thread structure 113 is formed on the end of the adjusting rod 112. The thread structure 113 is combined with the blade holder 114 for adjusting a length of the blade 116 protruding from an opening 136 formed on the pressing foot assembly 106.

Figure 3:
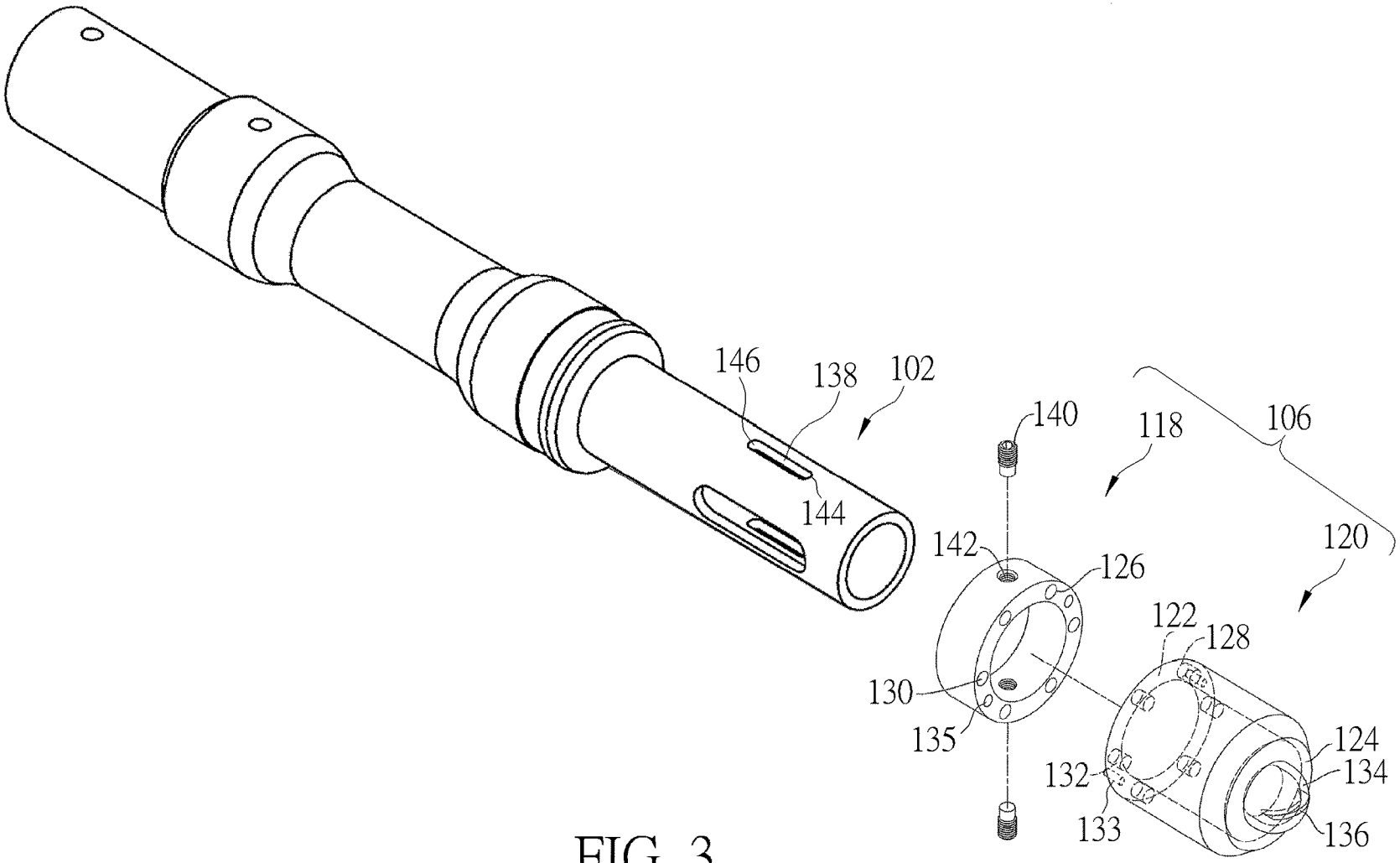
FIG. 3 is a partial exploded diagram of a pipe and a pressing foot assembly of the cutting tool according to the embodiment of the present invention.

Please refer to FIG. 2 and FIG. 3. FIG. 3 is a partial exploded diagram of the pipe 102 and the pressing foot assembly 106 of the cutting tool 100 according to the embodiment of the present invention. As shown in FIG. 2 and FIG. 3, the pressing foot assembly 106 includes an adapter ring 118 and a pressing foot 120. The adapter ring 118 abuts against the spring 108. The pressing foot 120 is detachably combined with the adapter ring 118. Specifically, the pressing foot 120 includes a combining end 122 and a free end 124. At least first assembling hole 126 is formed on the adapter ring 118. At least one second assembling hole 128 is formed on the combining end 122 of the pressing foot 120 and corresponding to the at least one first assembling hole 126. For example, six assembling holes 126 are formed on the adapter ring 118, and six second assembling holes 128 are formed on the combining end 122 of the pressing foot 120 and corresponding to the six first assembling holes 126, in this embodiment. The pressing foot assembly 106 further includes at least one first magnetic member 130 and at least one second magnetic member 132. For example, the six first magnetic members 130 are fixed inside the six first assembling holes 126, and the six second magnetic members 132 are fixed inside the six second assembling holes 128. However, the numbers of the first assembling hole 126, the second assembling hole 128, the first magnetic member 130, and the second magnetic member 132 are not limited to this embodiment. The first magnetic members 130 and the second magnetic members 132 attract with each other, such that the combining end 122 of the pressing foot 120 is detachably combined with the adapter ring 118, which brings convenience in replacing the pressing foot 120. However, a combining mechanism of the pressing foot 120 and the adapter ring 118 is not limited to this embodiment. For example, the pressing foot 120 can be combined with the adapter ring 118 by a screwing manner. Furthermore, the pressing foot assembly 106 further includes a register pin 133 and a register hole 135. The register hole 135 is formed on one of the adapter ring 118 and the pressing foot 120. The register pin 133 is disposed on the other one of the adapter ring 118 and the pressing foot 120. In this embodiment, the register hole 135 is formed on an end of the adapter ring 118 close to the pressing foot 120. The register pin 133 is disposed on an end of the pressing foot 120 close to the adapter ring 118 and protrudes from the combining end 122. The register pin 133 engages with the register hole 135, such that a direction of the opening 136 is parallel to a direction of the blade 116.

Figure 4:
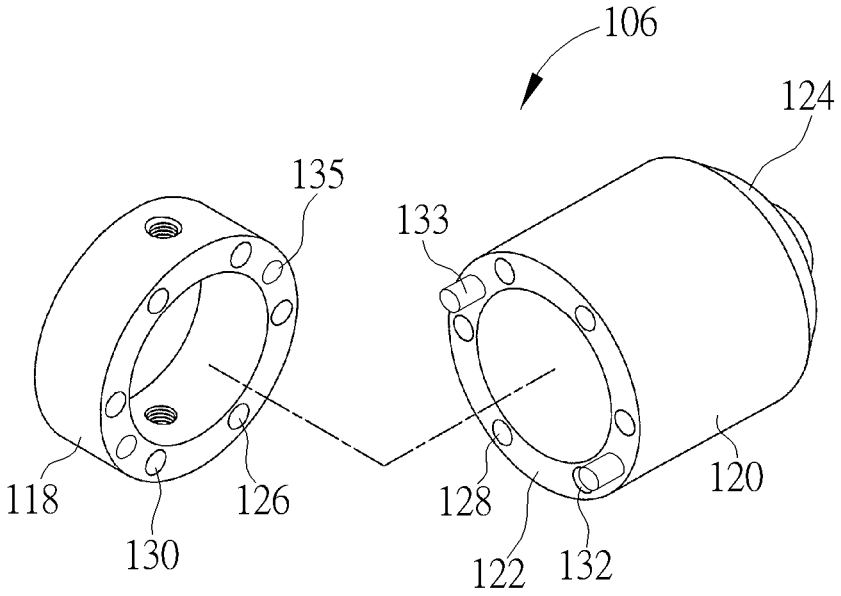
FIG. 4 is a partial exploded diagram of the pressing foot assembly of the cutting tool according to the embodiment of the present invention.
Figure 5:
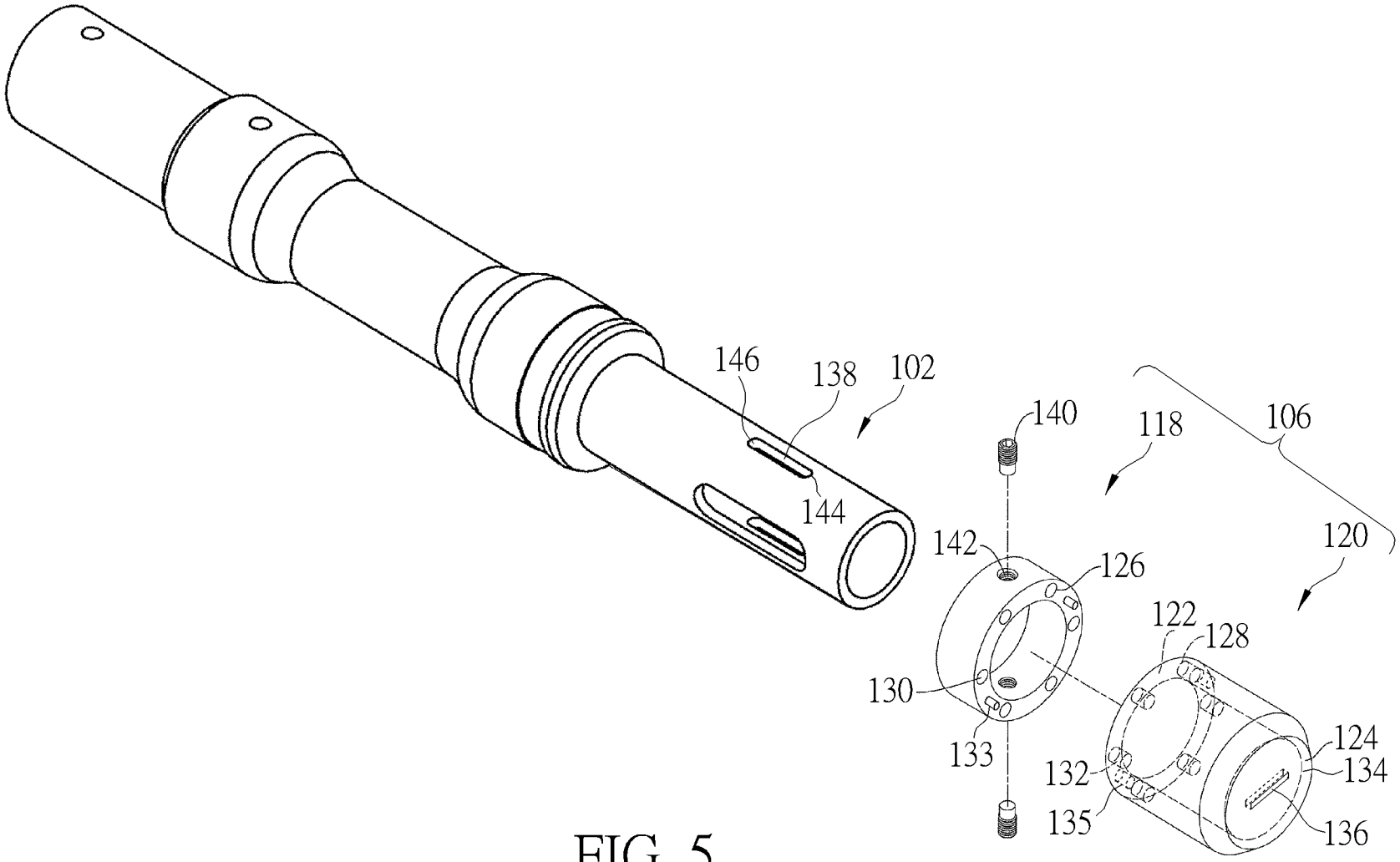
FIG. 5 is a partial exploded diagram of a pipe and a pressing foot assembly of a cutting tool according to another embodiment of the present invention.

Please refer to FIG. 3 and FIG. 4. FIG. 4 is a partial exploded diagram of the pressing foot assembly 106 of the cutting tool 100 according to the embodiment of the present invention. As shown in FIG. 3 and FIG. 4, in this embodiment, a protrusion 134 is formed on the free end 124 of the pressing foot 120, and the opening 136 is formed on the protrusion 134. Furthermore, the protrusion 134 can be an arc protrusion. Please refer to FIG. 5. FIG. 5 is a partial exploded diagram of the pipe 102 and the pressing foot assembly 106 of the cutting tool 100 according to another embodiment of the present invention. Different from the cutting tool 100 in aforementioned embodiment, instead of the arc protrusion, a flat portion is formed on the free end 124 of the pressing foot 120, and the opening 136 is formed on the flat portion. That is, a shape of the free end 124 of the pressing foot 120 is not limited to the aforementioned embodiments. It depends on practical design demands. In other words, the free end 124 of the pressing foot 120 of the present invention can be designed as a structure with a different arc shape according to a height or a property of wave-shaped core layers of an object. For example, when it is desired to cut a thicker object, such as a corrugated sheet, the free end 124 of the pressing foot 120 with the arc protrusion can be utilized for pressing against the thicker object. When it is desired to cut a thinner object, such as a solid sheet, the free end 124 of the pressing foot 120 with the flat portion can be utilized for pressing the thinner object. Furthermore, since the pressing foot 120 is detachably combined with the adapter ring 118 by the first magnetic members 130 and the second magnetic members 132 attracting with each other, it is easy to detach the original pressing foot 120 from the adapter ring 118 and combine another pressing foot 120 with the adapter ring 118 for cutting another object with a different height, so as to complete replacement of the pressing foot 120 conveniently.

As shown in FIG. 2 and FIG. 3, a sliding slot 138 is formed on the pipe 102. The pressing foot assembly 106 further includes a sliding block 140 disposed on a location corresponding to the sliding slot 138. The sliding slot 138 cooperates with the sliding block 140 for guiding the pressing foot assembly 106 to slide relative to the pipe 102, such that the spring 108 is compressed by the pipe 102 and the pressing foot assembly 106. Specifically, in this embodiment, the sliding block 140 can be a screw member. Furthermore, a screw hole 142 is formed on the adapter ring 118 of the pressing foot assembly 106 and corresponding to the sliding slot 138. The screw member is screwed in the screw hole 142 and accommodated in the sliding slot 138. The sliding slot 138 has a first end 144 and a second end 146. The screw member can slide back and forth between the first end 144 and the second end 146 of the sliding slot 138. However, the configuration and the number of the sliding slot 138 and the sliding block 140 are not limited to the aforementioned embodiment. It depends on practical design demands.

Figure 6:
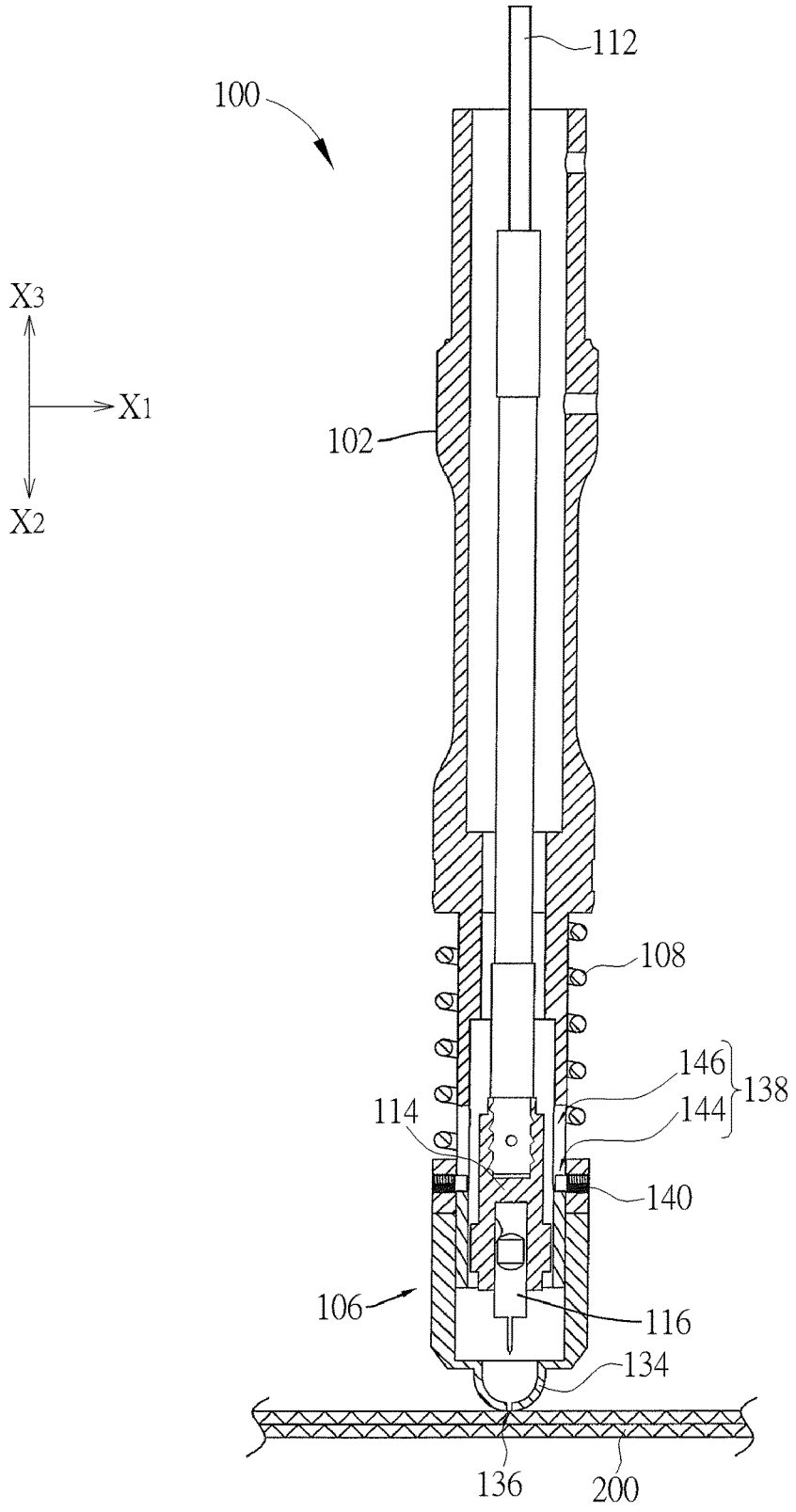
FIG. 6 and FIG. 7 are sectional diagrams of the cutting tool at different positions according to the embodiment of the present invention.
Figure 7:
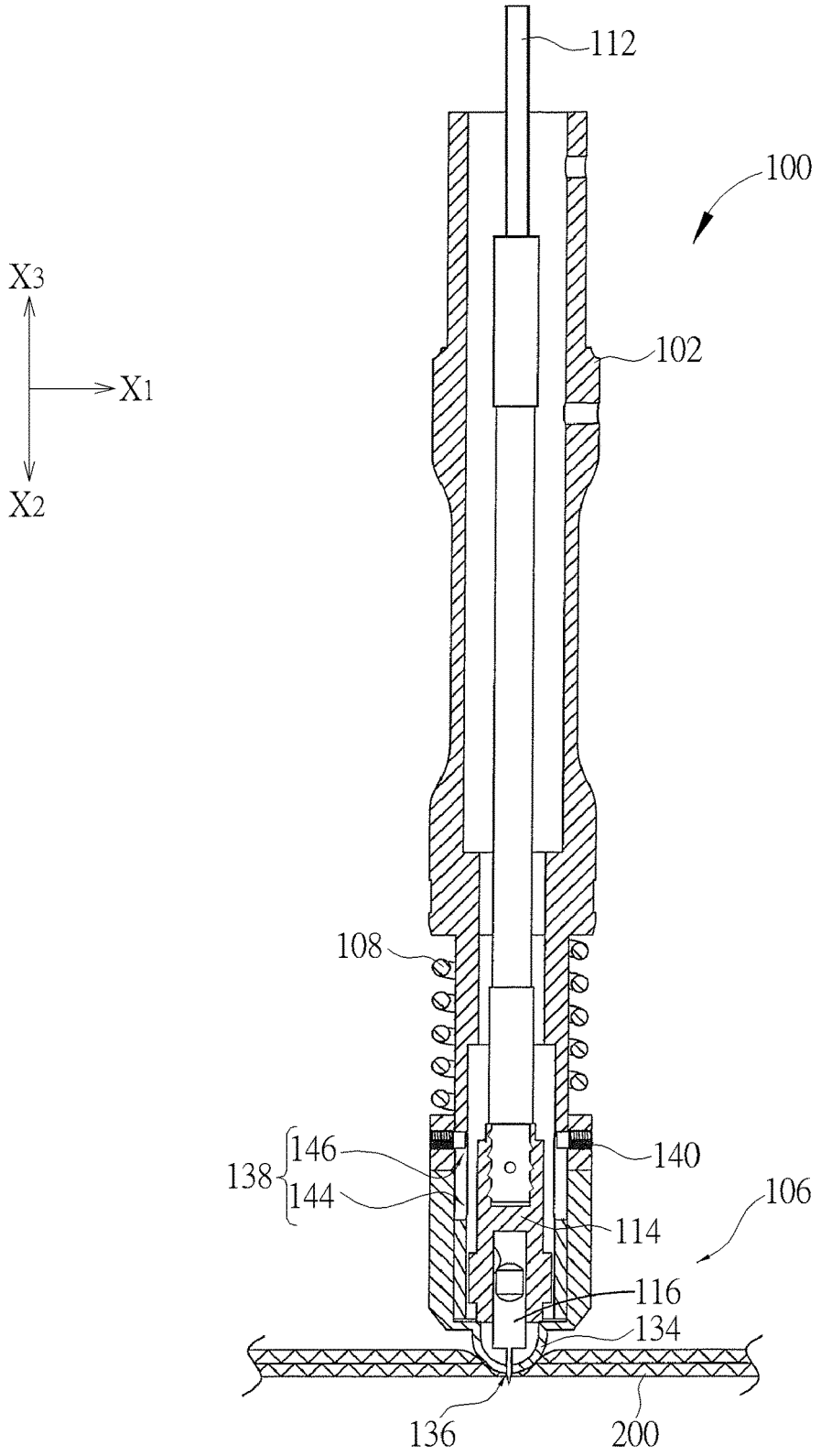
Figure 8:
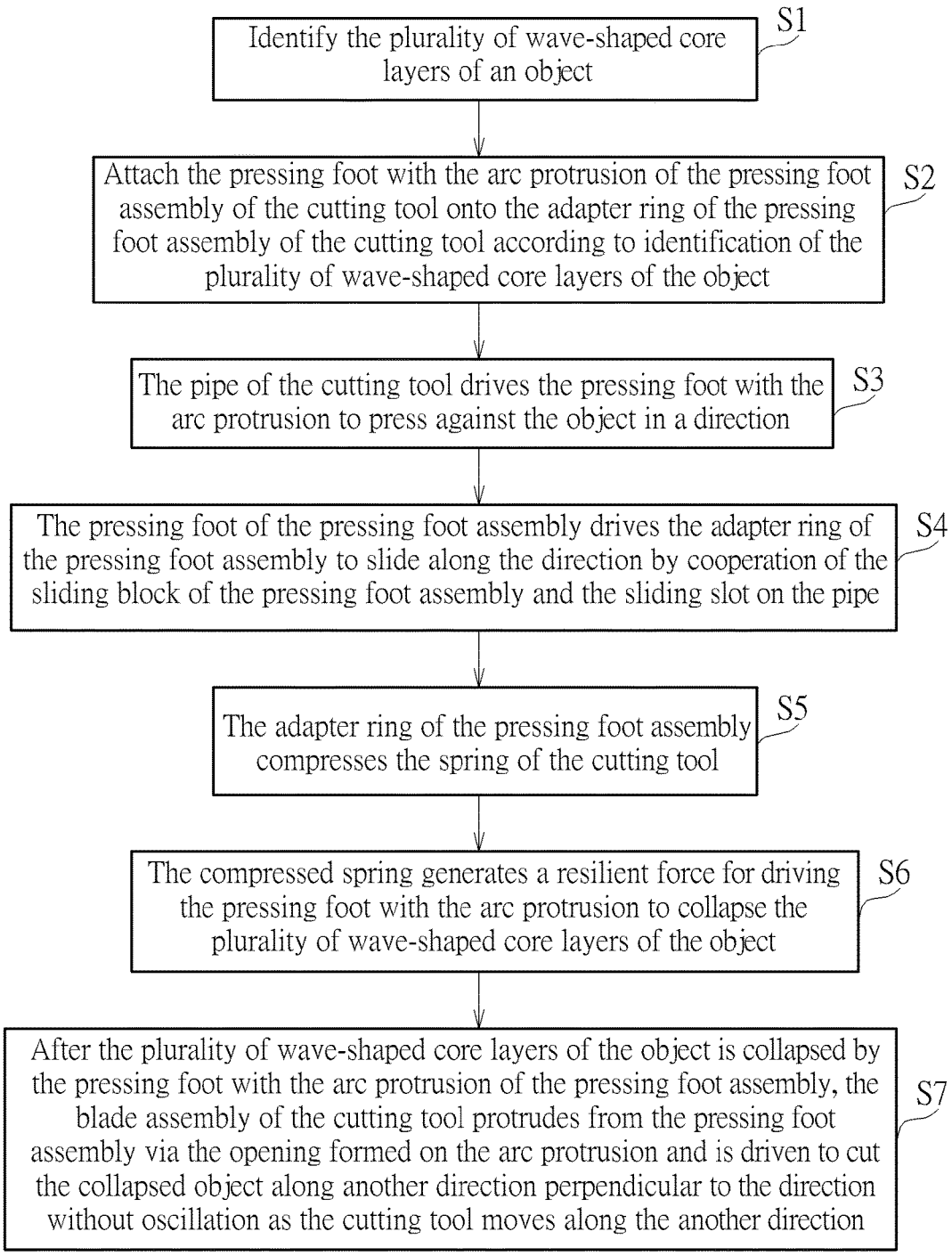
FIG. 8 is a flow chart diagram illustrating a cutting method according to the embodiment of the present invention

Operational principle of the cutting tool 100 according to the embodiment of the present invention is described as follows. Please refer to FIG. 6 to FIG. 8. FIG. 6 and FIG. 7 are sectional diagrams of the cutting tool 100 at different positions according to the embodiment of the present invention. FIG. 8 is a flow chart diagram illustrating a cutting method according to the embodiment of the present invention. As shown in FIG. 8, the cutting method includes the following steps:

S1: Identify the plurality of wave-shaped core layers of an object 200.

S2: Attach the pressing foot 120 with the arc protrusion of the pressing foot assembly 106 of the cutting tool 100 onto the adapter ring 118 of the pressing foot assembly 106 of the cutting tool 100 according to identification of the plurality of wave-shaped core layers of the object 200.

S3: The pipe 102 of the cutting tool 100 drives the pressing foot 120 with the arc protrusion to press against the object 200 in a direction.

S4: The pressing foot 120 of the pressing foot assembly 106 drives the adapter ring 118 of the pressing foot assembly 106 to slide along the direction by cooperation of the sliding block 140 of the pressing foot assembly 106 and the sliding slot 138 on the pipe 103.

S5: The adapter ring 118 of the pressing foot assembly 106 compresses the spring 108 of the cutting tool 100.

S6: The compressed spring 108 generates a resilient force for driving the pressing foot 120 with the arc protrusion to collapse the plurality of wave-shaped core layers of the object 200.

S7: After the plurality of wave-shaped core layers of the object 200 is collapsed by the pressing foot 120 with the arc protrusion of the pressing foot assembly 106, the blade assembly 110 of the cutting tool 100 protrudes from the pressing foot assembly 106 via the opening 136 formed on the arc protrusion and is driven to cut the collapsed object 200 along another direction perpendicular to the direction without oscillation as the cutting tool 100 moves along the another direction.

Before cutting the object 200, a user can identify whether the object 200 is a corrugated sheet with wave-shaped core layers or a solid sheet firstly (step S1). When the object 200 is identified as a corrugated sheet, the user can attach the pressing foot 120 with the arc protrusion onto the adapter ring 118 easily by cooperation of the register pin 133 and register hole 135 and cooperation of the first magnetic members 130 and the second magnetic members 132 (step S2). Furthermore, if it is required, the user can further adjust the length of the blade 116 protruding from the opening 136 formed on the pressing foot assembly 106 by the thread structure 113 after attachment of the pressing foot 120. As shown in FIG. 6, the sliding block 140 is located at the first end 144 of the sliding slot 138, and the blade 116 is received in the pressing foot assembly 106. As shown in FIG. 7, when it is desired to cut the object 200, such as a corrugated sheet with wave-shaped core layers, along a first direction X1, the pipe 102 drives the protrusion 134 of the pressing foot assembly 106 to keep pressing against the object 200 along a second direction X2 substantially perpendicular to the first direction X1, such that the sliding block 140 slides to the second end 146 of the sliding slot 138 (steps S3 and S4). In the meantime, the spring 108 is compressed for providing a buffering effect, and the blade 116 protrudes from the opening 136 and moves along the first direction X1, such that the blade 116 cuts the object 200 along the first direction X1 during a process that the protrusion 134 of the pressing foot assembly 106 keeps pressing against the object 200 along the second direction X2 (steps S5 to S7).

It should be noted that when the object 200 is a corrugated sheet with wave-shaped core layers, the cutting tool 100 can utilize the free end 124 of the pressing foot 120 with the arc protrusion and the spring 108 with a higher elasticity coefficient (K) for pressing against the corrugated sheet. Since the spring 108 with the higher elasticity coefficient can provide a larger resilient recovering force during a process that the pressing foot assembly 106 keeps pressing against the corrugated sheet, the pressing foot 120 with the arc protrusion collapses the wave-shaped core layers, so that the corrugated sheet can be considered as a plurality of overlaid solid sheets. Therefore, the pressing foot 120 presses against the corrugated sheet and the blade 116 cuts the corrugated sheet along a cutting path at the same time, which allows a computer-aided manufacturing (CAM) machine to process a cutting operation in a maximum cutting speed and improves a cutting effect of the corrugated sheet. Furthermore, the blade assembly 110 of the present invention can be a tangential knife tool instead of an oscillating knife tool, which allows the cutting tool 100 to execute an effective cutting operation in the maximum cutting speed of the CAM machine and improves an overall cutting performance. Besides, after the blade 116 finishes a cutting process that the blade 116 moves along the first direction X1 by a specific distance, the blade 116 is to move to the next cutting point and execute the cutting operation as mentioned above. During a process that the blade 116 moves to the next cutting point, the pipe 102 moves along a third direction X3 opposite to the second direction X2, such that the protrusion 134 separates from the corrugated sheet. At this moment, the blade 116 is received in the pressing foot assembly 106 again, which prevents other portions of the corrugated sheet from being crushed by the protrusion 134 or the blade 116. Furthermore, structural design of a corrugated box is normally based on a thickness of a collapsed edge of a corrugated sheet. In the prior art, a corrugated sheet is cut without being collapsed. Therefore, it is still required to collapse an engaging portion of a corrugated sheet by hands or other tools for being inserted into a corresponding slot in the prior art. In the present invention, since an engaging portion of a corrugated sheet has already been collapsed by the pressing foot 120, it is not required to process the conventional and additional collapsing operation as mentioned above.

On the other hand, when the object 200 is a solid sheet, the cutting tool 100 can utilize the free end 124 of the pressing foot 120 with the flat portion and the spring 108 with lower elasticity coefficient because the solid sheet cannot be collapsed like the corrugated sheet with wave-shaped core layers. When the blade 116 moves up and down along a Z axis, i.e., the second direction X2 or the third direction X3, and moves along the first direction X1 in an X-Y plane to cut the solid sheet, the pressing foot 120 does not depart from the solid sheet by the resilient recovering force generated from the spring 108, such that the pressing foot 120 can flat a cutting trace on the solid sheet and make sure that flatness of the cut solid sheet is similar to flatness of the uncut solid sheet. However, in the prior art, a gap or a through hole is formed on a solid sheet because of a thickness of a conventional blade, which results in air communication and reduces a sucking ability of an air compressor. Therefore, the solid sheet cannot be fixed stably on a desktop or a working platform during a cutting process in the prior art. When it is desired to cut a precise pattern, a gap or a through hole results in air communication and a solid sheet cannot be fixed stably, which leads the solid sheet to be torn by the blade and fails to complete the cutting process in the prior art. In the present invention, even when a solid sheet is pulled up by the blade 116, the pressing foot 120 can stop the solid paper and prevent a through hole or a gap from being formed on the solid sheet to avoid the air communication, such that the solid sheet is fixed stably. In other words, since the pressing foot 120 does not depart from the solid sheet when cutting, the pressing foot 120 flats a cutting trace and fixes the solid sheet for ensuring completeness of the solid sheet and preventing the air communication, which allows the compressor to suck the solid paper and ensures that the solid paper is fixed on a desktop or a working platform stably.

In contrast to the prior art, the pressing foot assembly of the cutting tool of the present invention keeps pressing against an object by the resilient force generated from the spring during a cutting process. When cutting a corrugated sheet, the wave-shaped core layers of the corrugated sheet are collapsed by the pressing foot assembly. The collapsed corrugated sheet is similar to a plurality of overlaid solid sheets, which allows the cutting tool to cut the collapsed corrugated sheet with a maximum cutting speed. In other words, since it is not required to drive the cutting tool to swing up and down by a motor anymore, a CAM machine can maximize a cutting speed to 100 percent of a design cutting speed when cutting the corrugated sheet without considering relations between the swinging amplitude of the cutting tool, properties of the corrugated sheet, and a horizontal moving speed of the cutting tool relative to the corrugated sheet. Furthermore, when cutting a solid sheet, it prevents the solid sheet from being pulled up by the blade, such that a through hole is prevented from being formed on the solid sheet, which allows the solid sheet to be fixed on a working platform stably and ensures a precise cutting effect. Besides, the present invention further utilizes the first magnetic members and the second magnetic members attracting with each other for detaching the pressing foot from the adapter ring or combining the pressing foot with the adapter ring conveniently. Therefore, when it is desired to cut another corrugated sheet with a different height or a solid sheet, it can replace the original pressing foot with another pressing foot conveniently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A cutting method comprising:

a pipe of a cutting tool driving a pressing foot of a pressing foot assembly of the cutting tool to press against an object in a direction;

the pressing foot of the pressing foot assembly driving an adapter ring of the pressing foot assembly to slide along the direction by cooperation of a sliding block of the pressing foot assembly and a sliding slot on the pipe;

the adapter ring of the pressing foot assembly compressing a spring of the cutting tool;

the compressed spring generating a resilient force for driving the pressing foot assembly to collapse a plurality of wave-shaped core layers of the object; and after the plurality of wave-shaped core layers of the object is collapsed by the pressing foot of the pressing foot assembly, a blade assembly of the cutting tool protruding from the pressing foot assembly via an opening formed on the pressing foot and being driven to cut the collapsed object along another direction perpendicular to the direction without oscillation as the cutting tool moves along the another direction.

2. The cutting method of claim 1, wherein after the plurality of wave-shaped core layers of the object is collapsed by the pressing foot of the pressing foot assembly, the blade assembly of the cutting tool protruding from the pressing foot assembly via the opening formed on the pressing foot and being driven to cut the collapsed object along the another direction perpendicular to the direction without oscillation as the cutting tool moves along the another direction comprises:

after the plurality of wave-shaped core layers of the object is collapsed by an arc protrusion formed on the pressing foot of the pressing foot assembly, the blade assembly of the cutting tool protruding from the pressing foot assembly via the opening formed on the arc protrusion on the pressing foot and being driven to cut the collapsed object along the another direction perpendicular to the direction without oscillation as the cutting tool moves along the another direction.

3. The cutting method of claim 1, further comprising:

adjusting a length of the blade protruding from the pressing foot assembly via the opening by an adjusting rod passing through the pipe and combined with a blade holder where the blade is fixed.

4. A cutting method comprising:

identifying a plurality of wave-shaped core layers of an object;

attaching a pressing foot with an arc protrusion of a pressing foot assembly of a cutting tool onto an adapter ring of the pressing foot assembly of the cutting tool according to identification of the plurality of wave-shaped core layers of the object;

a pipe of the cutting tool driving the pressing foot with the arc protrusion to press against the object in a direction;

the pressing foot of the pressing foot assembly driving the adapter ring of the pressing foot assembly to slide along the direction by cooperation of a sliding block of the pressing foot assembly and a sliding slot on the pipe;

the adapter ring of the pressing foot assembly compressing a spring of the cutting tool;

the compressed spring generating a resilient force for driving the pressing foot with the arc protrusion to collapse the plurality of wave-shaped core layers of the object; and after the plurality of wave-shaped core layers of the object is collapsed by the pressing foot with the arc protrusion of the pressing foot assembly, a blade assembly of the cutting tool protruding from the pressing foot assembly via an opening formed on the arc protrusion and being driven to cut the collapsed object along another direction perpendicular to the direction without oscillation as the cutting tool moves along the another direction.

5. The cutting method of claim 4, wherein attaching the pressing foot with the arc protrusion of the pressing foot assembly of the cutting tool onto the adapter ring of the pressing foot assembly of the cutting tool according to the identification of the plurality of wave-shaped core layers of the object comprises:

attaching the pressing foot with the arc protrusion of the pressing foot assembly of the cutting tool onto the adapter ring of the pressing foot assembly of the cutting tool by a first magnetic member disposed on the adapter ring and a second magnetic member disposed on the pressing foot and attracting with the first magnetic member according to the identification of the plurality of wave-shaped core layers of the object.

6. The cutting method of claim 4, wherein attaching the pressing foot with the arc protrusion of the pressing foot assembly of the cutting tool onto the adapter ring of the pressing foot assembly of the cutting tool according to the identification of the plurality of wave-shaped core layers of the object comprises:

engaging a register pin disposed on one of the adapter ring and the pressing foot with a register hole formed on the other one of the adapter ring and the pressing foot, such that a direction of the opening is parallel to a direction of the blade.

7. The cutting method of claim 4, further comprising:

adjusting a length of the blade protruding from the pressing foot assembly via the opening by an adjusting rod passing through the pipe and combined with a blade holder where the blade is fixed.

* * * * *